US010299524B2

(12) United States Patent
Saturnio

(10) Patent No.: US 10,299,524 B2
(45) Date of Patent: May 28, 2019

(54) GARMENT HAVING A DRAWSTRING CLOSURE ASSEMBLY

(71) Applicant: Hylete, Inc., Solana Beach, CA (US)

(72) Inventor: Christopher Saturnio, San Marcos, CA (US)

(73) Assignee: Hylete, Inc., Solana Beach, CA (US)

( * ) Notice: Subject to any disclaimer, the term of this patent is extended or adjusted under 35 U.S.C. 154(b) by 103 days.

(21) Appl. No.: 15/398,086

(22) Filed: Jan. 4, 2017

(65) Prior Publication Data

US 2018/0184739 A1 Jul. 5, 2018

(51) Int. Cl.
*A41F 9/02* (2006.01)

(52) U.S. Cl.
CPC ..... *A41F 9/025* (2013.01); *A41D 2300/33* (2013.01)

(58) Field of Classification Search
CPC ... A41F 9/025; A41F 9/02; A41F 9/00; A41D 1/08; A41D 7/00; A41D 7/005; A41D 2300/33
USPC ..... 2/67, 237, 238
See application file for complete search history.

(56) References Cited

U.S. PATENT DOCUMENTS 181,155 A * 8/1876 Eager ..... A41F 9/02 2/237
699,513 A 5/1902 Garms
770,871 A * 9/1904 Slater ..... A43C 11/18 2/218
898,511 A * 9/1908 Schneider ..... A41D 1/21 2/221
918,324 A 4/1909 Holdgate
1,018,009 A * 2/1912 Schremp ..... A41B 9/001 2/237
1,366,811 A 1/1921 Kops
1,937,356 A * 11/1933 Neustadt ..... A41B 9/02 2/237
2,113,731 A * 4/1938 Kennedy ..... A41F 1/06 2/162
2,130,942 A 9/1938 Blumberg
RE21,803 E 5/1941 Terry
2,326,380 A * 8/1943 Miller ..... A41B 9/14 2/404
2,349,019 A 5/1944 Terrell
2,397,211 A 3/1946 Schubert
2,463,884 A 3/1949 Kispert
2,559,953 A * 7/1951 Evans ..... A41D 1/00 2/70
2,581,366 A * 1/1952 De Grazia ..... A42B 1/045 2/203
3,161,890 A 12/1964 Betz
3,589,366 A 6/1971 Feather
(Continued)

FOREIGN PATENT DOCUMENTS

EP 2011410 1/2009
WO WO 2013160923 10/2013

*Primary Examiner* — Alissa L Hoey
(74) *Attorney, Agent, or Firm* — Tsircou Law, PC

(57) ABSTRACT

A closing and tightening system for the waistband of a garment is provided. Two drawstrings are fed through four grommets. When both strings are pulled tight, both sides of the garment are pulled towards each other, and are secured on top of each other when tied down. The strings are woven through the grommets to allow the garment to be tightened on both sides, creating a secure attachment suited to use on athletic wear.

10 Claims, 4 Drawing Sheets

(56) References Cited

U.S. PATENT DOCUMENTS 3,696,474 A * 10/1972 Slauta ..... A41F 1/00 2/84
3,718,105 A 2/1973 Glindmeyer
4,106,125 A 8/1978 Palumbo
4,164,044 A 8/1979 Holmes
4,164,792 A 8/1979 Ito
4,477,928 A * 10/1984 Graff ..... A41F 9/025 2/221
5,036,548 A 8/1991 Grilliot et al.
5,577,306 A * 11/1996 Gold ..... A41F 1/06 24/300
6,081,930 A 7/2000 Phillips
6,199,215 B1 * 3/2001 Biggerstaff ..... A41D 1/06 2/234
6,526,597 B1 3/2003 Shepard
6,618,863 B2 * 9/2003 Blechman ..... A41F 9/025 2/108
6,668,386 B2 12/2003 Vidal
6,687,919 B2 2/2004 Dilworth et al.
6,715,155 B2 4/2004 Duflos
6,804,832 B2 10/2004 Beland
6,892,399 B1 5/2005 Rocha
D513,658 S 1/2006 Langmyr
7,131,147 B2 11/2006 Villegas
7,174,574 B2 * 2/2007 Fontes ..... A41D 1/06 2/227
7,516,499 B2 4/2009 Gardner
7,930,769 B2 * 4/2011 Stern ..... A41D 1/00 2/243.1
7,950,070 B2 * 5/2011 Beven ..... A41B 9/026 2/234
8,214,922 B2 7/2012 Moore et al.
8,429,762 B2 4/2013 Weisman
8,522,365 B2 * 9/2013 Geary ..... A41F 1/00 2/235
8,555,415 B2 10/2013 Bradstreet et al.
8,561,215 B2 10/2013 Escudero Munoz
8,757,455 B2 1/2014 Smalley
8,656,517 B2 2/2014 Takahashi
8,875,313 B2 11/2014 Ramirez
8,966,667 B2 3/2015 Peck et al.
9,078,476 B2 7/2015 Haueter
2005/0022285 A1 2/2005 Berns et al.
2006/0156518 A1 7/2006 Frank
2006/0282933 A1 12/2006 Chambliss et al.
2007/0028363 A1 2/2007 Hansen
2009/0007314 A1 1/2009 Beven
2009/0007316 A1 1/2009 Escudero Munoz
2009/0100569 A1 4/2009 Butler
2009/0100717 A1 4/2009 Cabanis
2010/0071230 A1 3/2010 Hassid et al.
2010/0122392 A1 5/2010 Clark
2010/0281597 A1 11/2010 Lang
2011/0225843 A1 9/2011 Kerns et al.
2012/0011638 A1 1/2012 Geary
2012/0096629 A1 4/2012 Swancutt et al.
2012/0117715 A1 5/2012 Weafer
2013/0007947 A1 1/2013 Moore et al.
2014/0026293 A1 1/2014 Quistian
2014/0047619 A1 2/2014 Singh et al.
2014/0053313 A1 2/2014 Berns et al.
2014/0325806 A1 11/2014 Foley et al.
2015/0007380 A1 1/2015 Hodgdon
2015/0020286 A1 1/2015 Wilson
2016/0262478 A1 9/2016 Moore et al.
2016/0270482 A1 * 9/2016 Krengel ..... A43C 7/00
2017/0325531 A1 * 11/2017 Lomax ..... A41F 9/025

* cited by examiner

GARMENT HAVING A DRAWSTRING CLOSURE ASSEMBLY

FIELD OF THE INVENTION

The present invention relates generally to a closing and tightening system, and, more specifically, to a drawstring closures for closing and tightening an opening such as a waistband of a garment.

BACKGROUND OF THE INVENTION

There are several mechanisms for securing a waistband opening of a garment including Velcro, zippers, buttons, and drawstrings. For athletic garments, it is particularly desirable for a garment to be securely tightened about the waist despite increased movement. For the waistband of athletic garments, it is particularly important to close the waistband securely, and in a low-profile way.

Typically, a drawstring is a single string threaded through an opening in the waistband of the garment. Traditionally, drawstrings are pulled tight toward one another and tied. When a traditional drawstring becomes untied, the waistband is loosened and the waist-closing effect ceases. Further, it is common for waistband systems to require a drawstring in conjunction with Velcro, zippers, snaps, et cetera because the drawstring alone does not provide sufficient closure.

It should be appreciated that there is a need for a drawstring closure that can secure the waistband of a garment firmly and in a low-profile fashion, without the need for an additional attachment mechanism.

SUMMARY OF THE INVENTION

Briefly, and in general terms, the invention is embodied in a closing and tightening system on the waistband of a clothing garment such as pants or shorts. The closure system may also be used for other garments, including but not limited to bathing suits, skirts, dresses, and jackets. The tightening system is comprised of strings, with a unique orientation to allow for secure and low-profile closure.

More specifically, in an exemplary embodiment, the invention has two strings, which are fed through grommets or openings on both sides of the fly of a garment. This allows the garment to be tightened and closed on both sides. This creates a more secure attachment than in a traditional drawstring, and the waist can be secure even if the strings are not tied together.

In a detailed aspect of an exemplary embodiment, both sides of the garment have two grommets located next to each other—an inside grommet located next to the opening of the fly, and an outside grommet located slightly further from the opening of the fly. Through the garment are threaded two strings, a first string, and a second string. The waistband has two sides, a top side, and a bottom side, defined so that the top side is oriented over the bottom side when the waistband is closed.

In another detailed aspect of an exemplary embodiment, the first string and second string are routed through the waistband of the garment so that the second string protrudes from the inside grommet on the top side and the first string protrudes from the outside grommet on the top side. When both strings are pulled tight, both sides of the garment are pulled towards each other, and are secured on top of each other when tied down.

In another detailed aspect of an exemplary embodiment, the grommets are oriented to face inward so that the strings exit the garment towards the wearer rather than away from the wearer.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
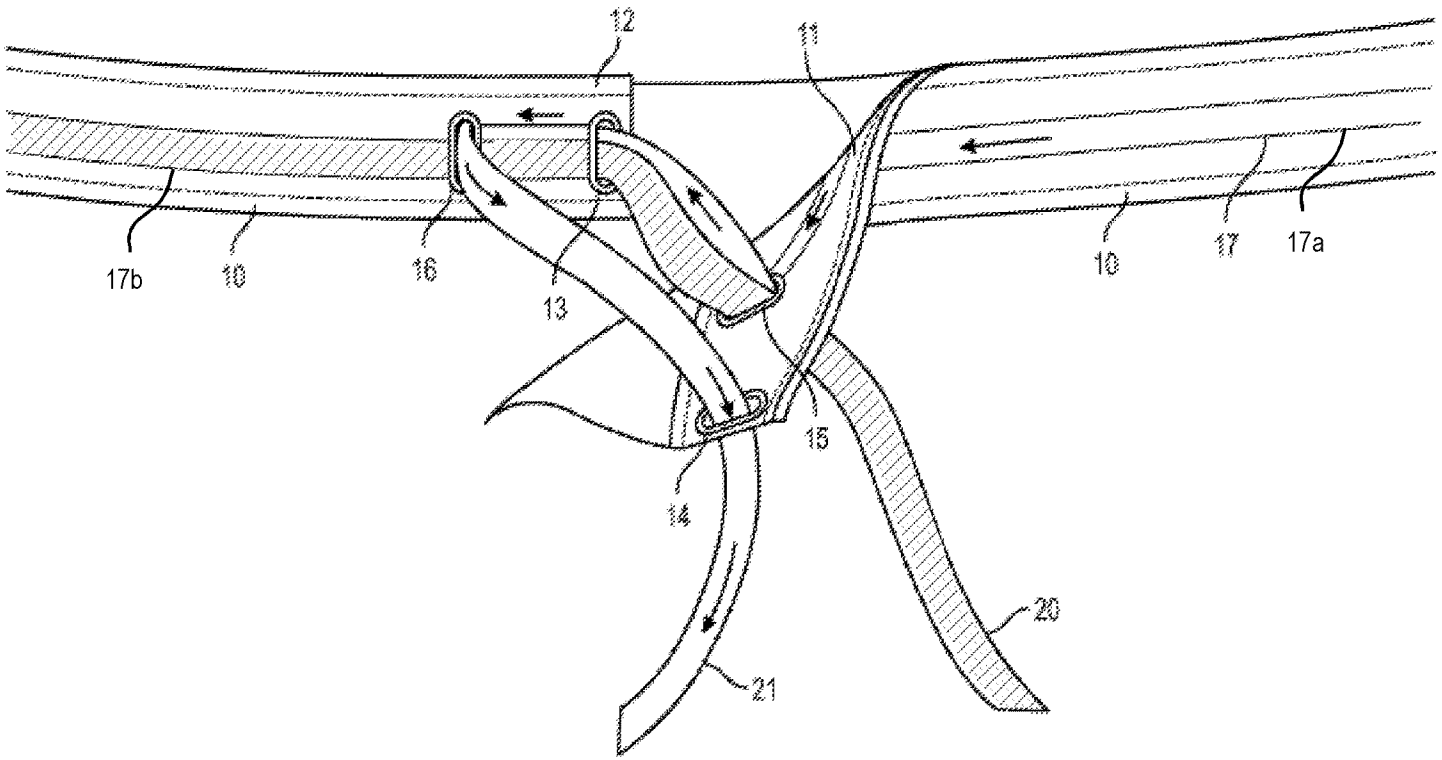
FIG. 1 is a front view of a drawstring closure in accordance with the present invention, depicting the drawstring closure implemented in waistband of a garment in which opposing sides of an opening each include a pair of grommets through which a pair of drawstring ends loop through in a prescribed manner.

Referring now to the drawings, and particularly FIG. 1, there is shown a garment having a drawstring closure assembly. The garment includes waistband 10 that defines a channel 17 (17*a* and 17*b*) and a drawstring threaded therethrough. The drawstring is threaded through a plurality of apertures (grommets), disposed proximate to a slit of the garment, to create a more secure attachment than in a traditional drawstring, such that the waist can be secure even if the strings are not tied together, providing a unique, stylish look.

In the exemplary embodiment, the waistband 10 has an outer side 11 and an interior side 12, defined so as the outer side 11 is laid over the interior side 12 when the closure is tightened. The waistband is fitted with several grommets 13, 14, 15, 16. Each side of the waistband has an inside grommet 13, 14 proximate to the fly opening and an outside grommet 15, 16 on the distal side of the inside grommet. The waistband includes a channel 17 and a drawstring threaded therethrough.

The drawstring has two opposing string portions, 20, 21. A first string portion 21 exits through the outside top grommet 15, then back into the waistband of the bottom side through the inside bottom grommet 13. The second first string is routed through the channel 17 (17*b*), exiting out the waistband at the outside bottom grommet 16, and back through the inside top grommet 14. A string portion 20 exits through the inside bottom grommet 13, and then through the outside top grommet 15. The first string protrudes from the inside top grommet 14; the second string protrudes from the outside top grommet 15. In other embodiment, the waistband may also use four openings that are not fitted with grommets.

In an exemplary embodiment, the inside top grommet (aka, opening) 14 can be sized smaller than one or more of the other grommets (openings), e.g., 13, 15, and/or 16. In other words, the grommet 14 can be sized to provide a snug fit for a single drawstring portion, to provide tension on the drawstring to help lock the drawstring in place. In a detailed feature of an exemplary embodiment, the inner diameter of the grommet (opening) 14 is less than or equal to the outer diameter of drawstring portion that passes therethrough. In this manner, the drawstring can be held in place before tying or can be held in place without tying.

Figure 2:
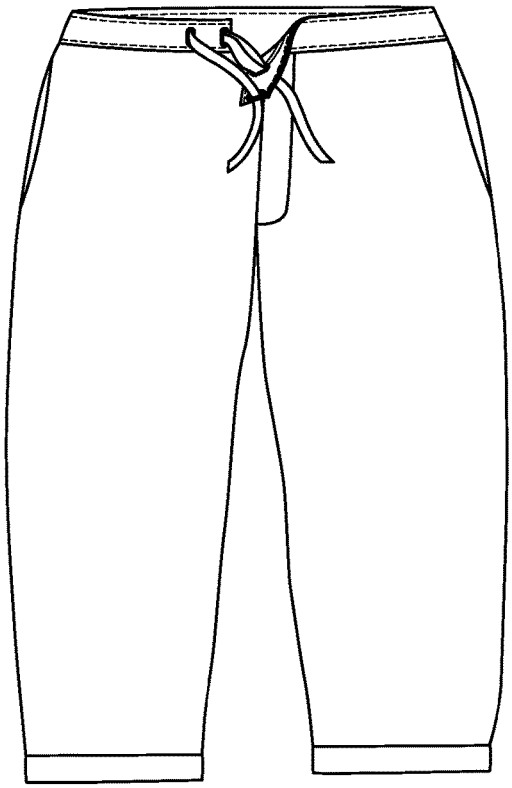
FIG. 2 is a front view of shorts in accordance with the present invention, utilizing the drawstring closure of FIG. 1.

With reference now to FIG. 2, athletic shorts are shown having a drawstring closure in accordance with the invention. The drawstring closure assembly includes a slit opening (fly) and a plurality of apertures disposed on both sides of the fly along the waistband. The waistband defines a channel. Two apertures are disposed a first side of the slit opening proximate to the edge, and two other apertures are disposed on a second side of the slit opening proximate to the edge. A first string portion is threaded, in a proximal to distal manner, to extend simultaneously through the first, the third, the fourth, and the second apertures, so that the first string portion exits the corresponding channel portion extending through the first aperture, reenters the corresponding channel portion extending through the third aperture, exits the corresponding channel portion extending through the fourth aperture, and extends through the second aperture. A second string portion exits the corresponding channel portion extending through the third aperture and extends through the first aperture.

Figure 3:
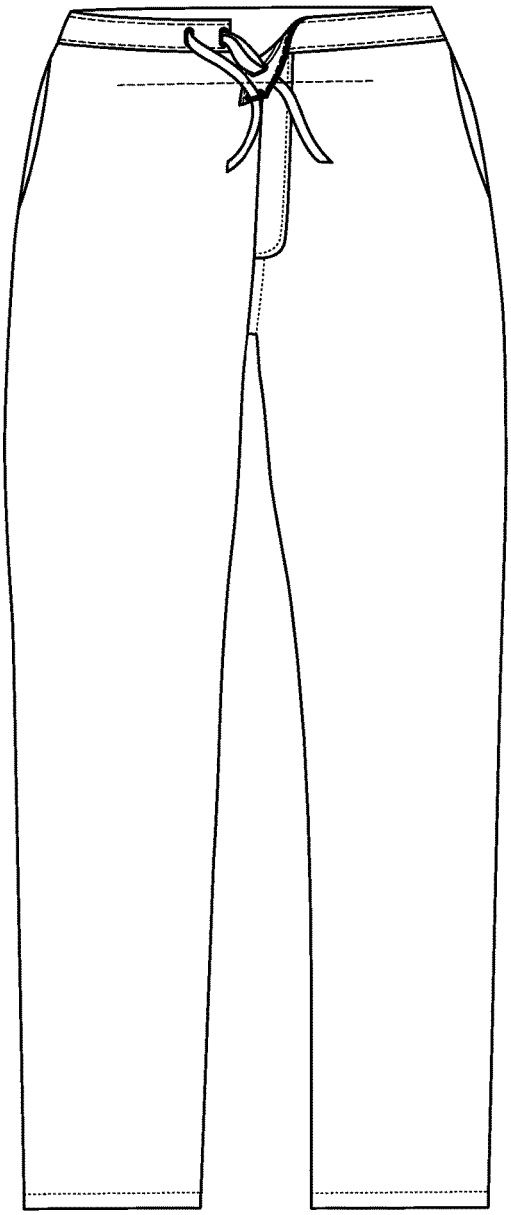
FIG. 3 is a front view of pants in accordance with the present invention, utilizing the drawstring closure of FIG. 1.

With reference to FIG. 3, pants are shown having a drawstring closure in accordance with the invention. Various other embodiments of garments are contemplated that can comprise a drawstring closure in accordance with the invention, such as swimsuits, sweatpants, stockings, sweatshirts, and others.

Figure 4:
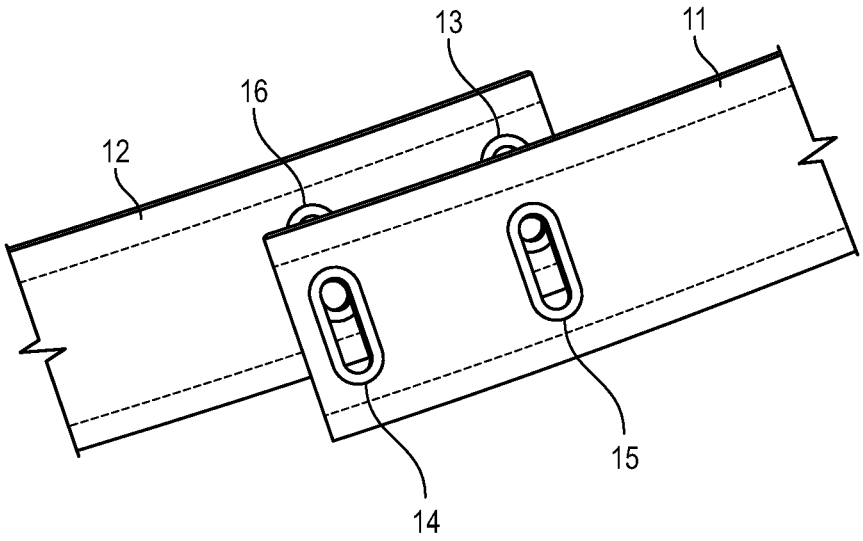
FIG. 4 a simplified perspective view of the grommets from FIG. 1, depicting the grommets of the closure partially overlapped, with the drawstring ends excluded for clarity.
Figure 5:
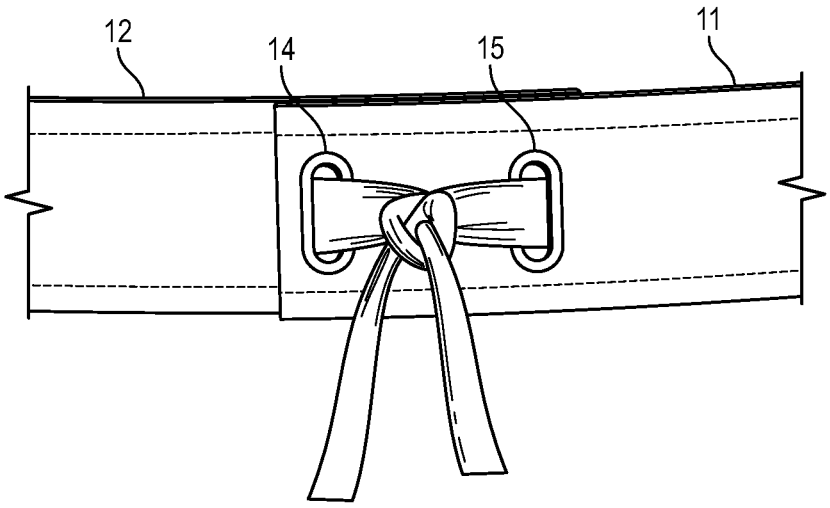
FIG. 5 a front view of the drawstring closure of FIG. 1, depicting the grommets of the aligned and the drawstring ends tied.

FIGS. 3-5 shows the waistband 10 of FIG. 1 lined up for closure. The inside grommet of one side matches the outside grommet of the other side when both sides 11, 12 are laid over each other (FIG. 4). When both strings 20, 21 are pulled tight, both sides of the garment 11, 12 are pulled towards each other, as well as being secured on top of each other when tied down (FIG. 5).

Figure 6:
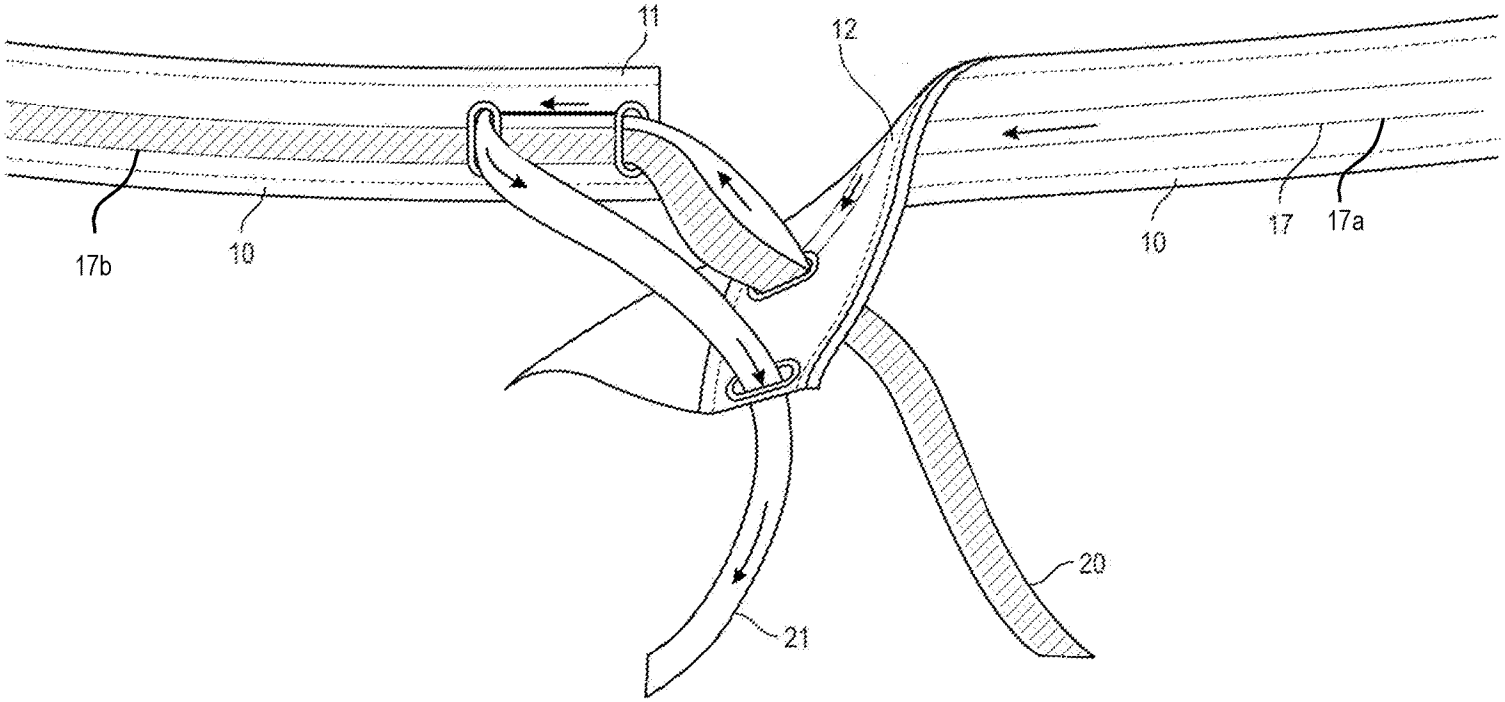
FIG. 6 is an interior view of a drawstring closure in accordance with the present invention, depicting the drawstring closure implemented in waistband of a garment in which a pair of drawstring ends loop through in a prescribed manner such that the ends terminate on the interior side of the garment, towards the wearer.

FIG. 6 shows another embodiment of the present invention wherein the grommets are inward-facing. Thus, the strings exit the garment towards the wearer rather than away from the wearer. The second string 20 exits the channel through an opening on the outer side 11 and runs through an opening on the interior side 12 to exit the garment. The first string 21 exits the channel through an opening on the interior side 12, reentering the channel through an opening on the outer side 11, exiting the channel through an opening on the outer side 11, and running through an opening on the interior side 12 to exit the garment.

It should be appreciated from the foregoing that the present invention provides a system for closing and tightening the waistband of a garment, using two strings threaded through the waistband. The strings are fed through four openings in a particular manner that results in a more secure fit than that achieved with a traditional drawstring. The strings may ultimately exit through the outside or through the inside of the waistband.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A garment having a drawstring closure assembly, comprising:

a garment body defines a slit opening that extends from an edge of the garment body, the garment body defining 1) a first channel portion proximate to the edge on a first side of the slit opening and 2) a second channel portion proximate to the edge on a second side of the slit opening, the garment body further having a plurality of apertures, including a first aperture defined on the first side of the slit opening, providing access to the first channel portion, a second aperture defined on the first side of the slit opening between the first aperture and the slit opening, a third aperture defined on the second side of the slit opening, the third aperture providing a first access to the second channel portion, and a fourth aperture defined on the second side of the slit opening such that the third aperture is between the fourth aperture and the slit opening, the fourth aperture providing a second access to the second channel portion;

a first string portion that extends from the first channel portion and is threaded in a proximal to distal manner through the first, the third, the fourth, and the second apertures, the first string portion entering the second channel portion via the first access and extending from the second channel portion via the second access; and a second string portion that extends from the second channel portion and is threaded through the third and the first apertures, the first and second string portions extending through the first and third apertures in opposing directions across the slit opening between the first and the third apertures so as to secure the first side and the second side together.

2. The garment as defined in claim 1, wherein the second aperture is smaller than the first aperture, the second aperture configured to hold the first string portion in place without the first string portion being tied.

3. The garment as defined in claim 1, wherein the plurality of apertures each include a grommet.

4. The garment as defined in claim 1, wherein the garment body is athletic shorts.

5. The garment as defined in claim 1, wherein the garment body is pants.

6. The garment as defined in claim 1, wherein the garment body is a swimsuit.

7. The garment as defined in claim 1, wherein the first side of the slit opening aligns atop the second side of the slit opening, such that the first and second apertures line up on top of the third and fourth apertures for closure.

8. A garment having a drawstring closure assembly, comprising:

a garment body that has a waistband and that defines a slit opening that extends downwardly from a top edge of the waistband, the waistband defines a channel proximate to the top edge that extends about the circumference of the waistband, the channel defining 1) a first channel portion proximate to the edge on a first side of the slit opening and 2) a second channel portion proximate to the edge on a second side of the slit opening, the garment body further having a plurality of apertures, including a first aperture defined on the first side of the slit opening, providing access to the first channel portion, a second aperture defined on the first side of the slit opening between the first aperture and the slit opening, a third aperture defined on the second side of the slit opening, the third aperture providing a first access to the second channel portion, and a fourth aperture defined on the second side of the slit opening such that the third aperture is between the fourth aperture and the slit opening, the fourth aperture providing a second access to the second channel portion; and a drawstring assembly disposed in the channel, having a first string portion that extends from the first side and a second string portion that extends from the second side, in which:

a first string portion that extends from the first channel portion is threaded in a proximal to distal manner through the first, the third, the fourth, and the second apertures, the first string portion entering the second channel portion via the first access and extending from the second channel portion via the second access; and a second string portion that extends from the second channel portion is threaded through the third and the first apertures, the first and second string portions extending through the first and third apertures in opposing directions across the slit opening between the first and the third apertures so as to secure the first side and the second side together.

9. The garment as defined in claim 8, wherein the first side of the slit opening aligns atop the second side of the slit opening, such that the first and second apertures line up on top of the third and fourth apertures for closure.

10. The garment as defined in claim 9, wherein the second aperture is smaller than the first aperture, the second aperture configured to hold the first string portion in place without the first string portion being tied.

* * * * *